United States Patent [19]

Haruch

[11] Patent Number: 4,828,182

[45] Date of Patent: May 9, 1989

[54] SPRAY NOZZLE ASSEMBLY WITH RECESSED DEFLECTOR

[75] Inventor: James Haruch, Naperville, Ill.

[73] Assignee: Spraying Systems Co., Wheaton, Ill.

[21] Appl. No.: 156,241

[22] Filed: Feb. 16, 1988

Related U.S. Application Data

[63] Continuation-in-part of Ser. No. 75,621, Jul. 20, 1987, which is a continuation-in-part of Ser. No. 815,117, Dec. 27, 1985, abandoned, which is a continuation of Ser. No. 602,227, Apr. 19, 1987, abandoned.

[51] Int. Cl.[4] ..... B05B 7/06; B05B 7/04; B05B 1/26; B05B 1/14

[52] U.S. Cl. ..... 239/432; 239/434; 239/510; 239/523; 239/553.3

[58] Field of Search ..... 239/432, 434, 509, 510, 239/512, 523, 524, 565, 553.3, DIG. 1

[56] References Cited

U.S. PATENT DOCUMENTS

| | | | |
|---|---|---|---|
| 971,516 | 10/1910 | Beaver | 239/523 |
| 1,051,135 | 1/1913 | Linderborg | 239/432 |
| 1,143,057 | 6/1915 | Meacham | 239/432 |
| 1,288,122 | 12/1918 | Mowry | 239/523 |
| 2,012,139 | 8/1935 | Peabody | 239/434 X |
| 2,352,130 | 6/1944 | Short et al. | 239/523 X |
| 2,864,652 | 12/1958 | O'Brien et al. | 239/523 |
| 3,029,030 | 4/1962 | Dey, Sr. | 239/524 |
| 3,240,254 | 3/1966 | Hughes | 239/434 X |
| 3,958,760 | 5/1976 | Rosenberg | 239/524 X |
| 4,221,334 | 9/1980 | Christopher | 239/523 X |
| 4,349,156 | 9/1982 | Haruch et al. | 239/432 |
| 4,591,099 | 5/1986 | Emery et al. | 239/434 X |
| 4,624,414 | 11/1986 | Ferrazza | 239/524 X |
| 4,660,598 | 4/1987 | Butterfield et al. | 251/331 X |

FOREIGN PATENT DOCUMENTS

| | | | |
|---|---|---|---|
| 375429 | 6/1932 | United Kingdom | 239/510 |
| 431723 | 7/1935 | United Kingdom | 239/434 |

*Primary Examiner*—Andres Kashnikow
*Attorney, Agent, or Firm*—Leydig, Voit & Mayer

[57] ABSTRACT

A spray nozzle assembly including a hollow nozzle body having an air inlet orifice through which a pressurized air stream is directed into the body, a liquid inlet orifice through which a pressurized liquid flow stream is directed into the body, an impingement member disposed within the body for breaking up the liquid and air flow streams and preatomizing the liquid, and a nozzle tip mounted at the discharge end of the body defining a discharge orifice. The nozzle tip is formed with a deflector flange downstream of the discharge orifice in transverse relation to the direction of travel of the preatomized liquid passing through the discharge orifice and the deflector flange is formed with a cup shaped recess in axial alignment with the discharge orifice into which the preatomized liquid is directed from the discharge orifice for causing further breakdown and atomization of the liquid which is thereupon directed by the deflector flange transversely in a substantially flat spray pattern. Alternative embodiment of spray tips with cup shaped deflectors are disclosed. The impingement member preferably is removably mounted within the nozzle body so as to enable the nozzle to be used in an air assisted mode of operation, or alternatively, in purely hydraulic mode of operation.

20 Claims, 2 Drawing Sheets

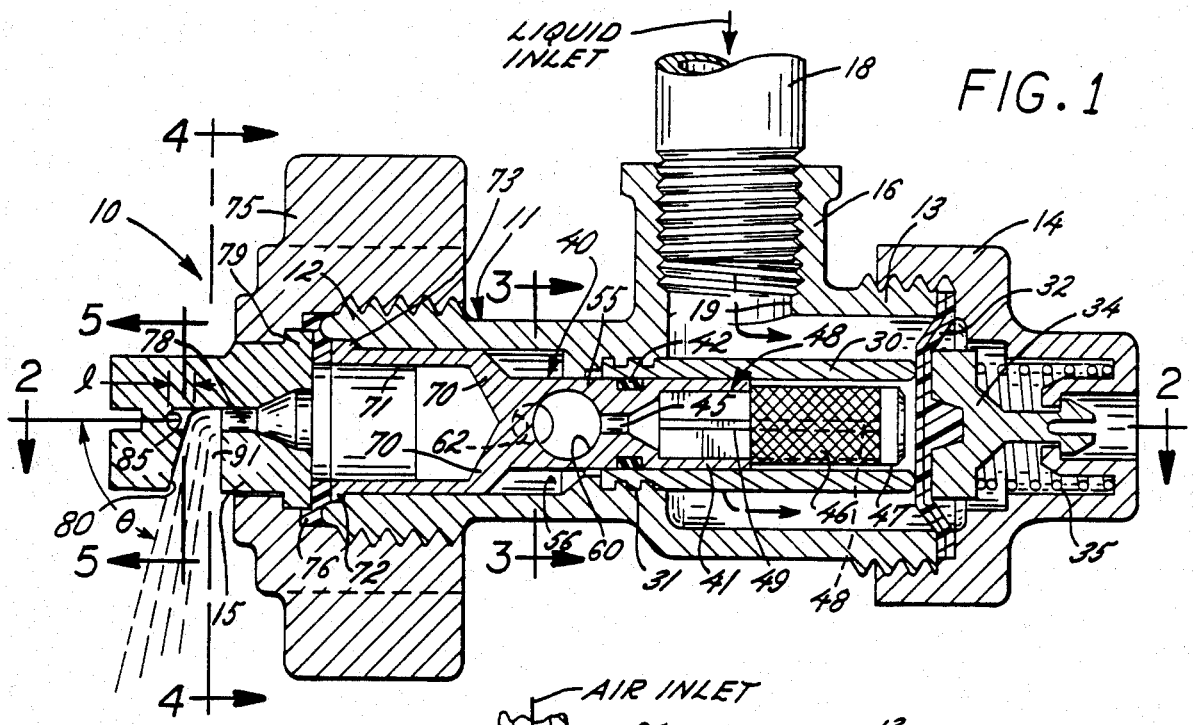
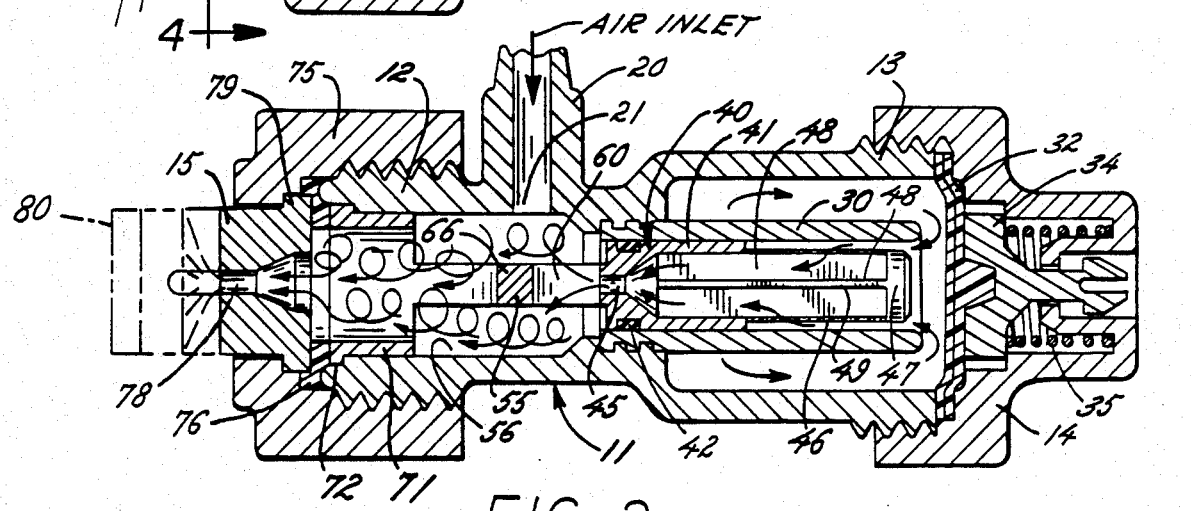
FIG. 2
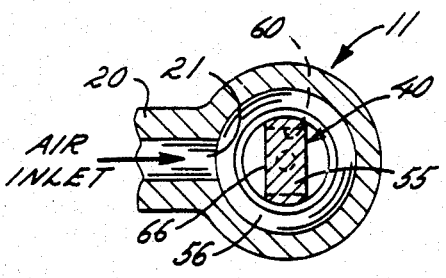
FIG. 3
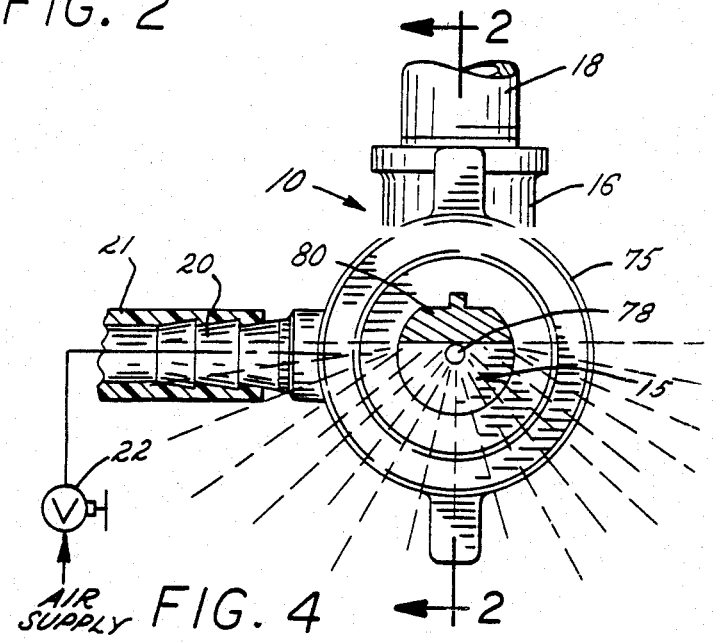
FIG. 4

SPRAY NOZZLE ASSEMBLY WITH RECESSED DEFLECTOR

DESCRIPTION OF THE INVENTION

This application is a continuation-in-part of application Ser. No. 075,621 filed July 20, 1987, which is a continuation of application Ser. No. 815,117, filed Dec. 27, 1985, now abandoned, which in turn was a continuation of application Ser. No. 602,227 filed Apr. 19, 1987, now abandoned.

The present invention relates to spray nozzles, and more particularly, to an improved spray nozzle that finds particular but not exclusive utility in humidification and evaporative cooling applications.

It is desirable that spray nozzle assemblies utilized in humidification and evaporative cooling systems generate relatively fine liquid particles, and for this purpose, it is known to employ high pressure, compressed air to provide mechanical energy to break up liquid and to facilitate atomization thereof. Many prior air assisted atomizing nozzles, however, have been uneconomical to operate because they required large air compressors and high pressure pumps in order to achieve sufficient liquid break down. High strength liquid and air conduits also are required in such systems, and special design considerations may be necessary to achieve proper sealing at high pressures. Moreover, while it is desirable that a spray be discharged in a wide relatively flat spray pattern so that more particles are exposed to the ambient air, which thereby enhances the humidification and/or evaporative cooling, many prior air assisted nozzles discharge with relatively tight round spray patterns.

It is an object of the present invention to provide a spray nozzle assembly that is adapted to more efficiently produce a spray pattern with fine liquid droplets.

Another object is to provide a spray nozzle assembly as characterized above that is adapted to direct the fine particle spray pattern in a flat spray discharge which maximizes exposure of the spray particles to the ambient air so as to enhance humidification and/or evaporation.

A further object is to provide a spray nozzle of the foregoing type which is operable to produce such a fine spray pattern while using relatively low liquid and air pressures.

Still another object is to provide a spray nozzle of the above kind which lends itself to economical manufacture, permitting the use of inexpensive plastic air and liquid supply lines and inexpensive low pressure sealing designs.

Other objects and advantages of the invention will become apparent upon reading the following detailed description and upon reference to the drawings, in which:

FIG. 1 is a vertical section of an illustrative spray nozzle assembly embodying the present invention;

FIG. 2 is a horizontal section of the spray nozzle shown in FIG. 1, taken in the plane of line 2—2 in FIG. 1;

FIG. 3 is a vertical section of the illustrated nozzle taken in the plane of line 3—3 in FIG. 1;

FIG. 4 is a fragmentary end elevational view, partially in section, of the illustrated spray nozzle assembly, taken in the plane of line 3—3 in FIG. 1;

Figure 5:
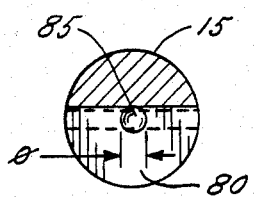
FIG. 5 is a vertical section of the spray tip of the illustrated nozzle assembly, taken in the plane of line 5—5 in FIG. 1.
Figure 6:
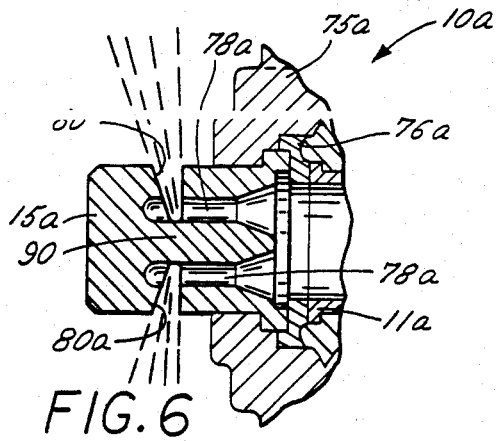
FIG. 6 is a fragmentary section of an alternative form of spray nozzle assembly embodying the present invention.
Figure 7A:
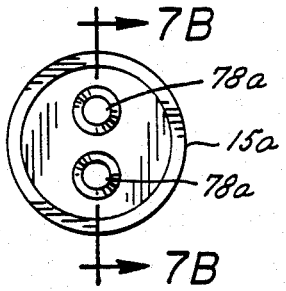
FIG. 7A is a rear end view of the nozzle tip of the nozzle assembly shown in FIG. 6, taken in the plane of line 7A–7A in FIG. 7C.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

Referring now more particularly to FIGS. 1–5 of the drawings, there is shown an illustrative spray nozzle assembly 10 embodying the present invention, which is particularly adapted for use in humidification and evaporative cooling systems. The spray nozzle assembly 10 includes an elongated hollow body 11 which may be molded of plastic and may be of a form substantially similar to that shown in my U.S. application Ser. No. 940,290. The elongated hollow body 11 is formed with opposite end hubs 12, 13, which are externally threaded. The hub 13 located at the upstream of the body 11 is closed by a cap 14 and a nozzle spray tip 15 is mounted adjacent the hub 12 at the downstream end of the body. An internally threaded hub 16 formed integrally with the body 11 projects from one side of the body and receives a threaded conduit 18 which communicates with a pressurized liquid source. The lower end of the hub 16 defines a liquid inlet orifice 19 through which liquid is introduced into the nozzle body. A hub 20 which defines an air inlet orifice 21 is located downstream of the liquid inlet orifice 19 and in 90° offset relation to the liquid inlet orifice. An air supply conduit 21 is coupled to the air inlet hub 20 for communicating pressurized air to the air inlet orifice 21 under the control of a shutoff valve 22 (FIG. 4).

Liquid admitted into the nozzle body 11 via the inlet orifice 19 is directed into a longitudinal flow stream by a cylindrical tube 30 (FIG. 2). The tube 30 is coaxial with and spaced inwardly from the wall of the body 11 and its downstream end is threadably connected to the body at 31. As disclosed in commonly assigned Butterfield et al. U.S. Pat. No. 4,660,598, the tube 30 coacts with a resiliently flexible diaphragm 32 to form an anti-drip valve that prevents liquid from dripping from the nozzle tip 15 after the supply of pressurized liquid to the inlet pipe 18 has been cut off. For this purpose, the diaphragm 32 is located adjacent the upstream end of the tube 30 and its peripheral margin is clamped between the end of the hub 13 and the cap 14. A valve follower 34 is supported slidably within the cap and is operably connected to the diaphragm. Telescoped into the cap is a coiled compression spring 35 which urges the diaphragm toward a closed position against the upstream end of the tube 30, as shown in FIG. 2. When liquid under pressure is delivered to the nozzle body 11 via the inlet pipe 18, the pressurized liquid urges the diaphragm 32 away from the upstream end of the tube 30, as shown in FIG. 2, so as to enable the liquid to flow through the tube and to be directed through the nozzle spray tip 15. Upon cutting off of the liquid at the pressure source, the spring 35 forces the diaphragm 32 into sealing engagement with the upstream end of the tube 30 so as to substantially prevent liquid from dripping out of the nozzle tip.

To facilitate preatomization of liquid introduced into the nozzle from the liquid inlet 19, a removable insert member 40 is provided within the nozzle of the body. The insert member 40, which is disclosed in greater detail in the aforementioned U.S. application Ser. No. 940,290, includes a tubular orifice member 41 (FIGS. 1 and 2) preferably made of brass of the like. The orifice member 41 is cylindrical and is telescoped into the downstream end of the tube 30 with a tight but sliding fit. An O-ring 42 fits within a groove around the outer periphery of the orifice member 41 and is compressed against the inner wall of the tube 30 to establish a seal between the orifice member and the tube. Formed through the downstream end portion of the orifice member 41 is a flow restricting orifice 45 which serves to reduce the flow rate of liquid flowing from the tube 30 toward the nozzle tip 20. In this particular instance, the orifice 45 includes a frustoconical upstream portion.

Dirt and other foreign particles are filtered from the liquid before the liquid flows through the orifice 45. For this purpose, a tubular screen-like strainer 46 extends from the upstream end of the orifice member 41 and is spaced radially inwardly from the wall of the tube 30 so that liquid entering the tube must pass radially through the strainer before flowing to the orifice 45. One end of the strainer 46 abuts the upstream end of the orifice member 41 while the other end of the strainer abuts and is closed off by the head 47 of a pin 48, which is telescoped slidably into both the strainer and the upstream end of the orifice member 41. The pin 48 preferably is of cruciform cross-section and is formed with four angularly spaced fins 49 which define flow passages permitting liquid to flow through the strainer and into the orifice member.

For breaking up the stream of liquid flowing through the orifice 45 and for causing the liquid to mix with a pressurized air stream, the insert member 40 includes an elongated impingement element 55. The impingement element 55 in this instance is in the form of an elongated flat bar formed integrally with the downstream end of the orifice member 41, the bar being of rectangular cross-section. As shown in FIGS. 1 and 2, the rectangular bar 55 is spaced inwardly from the circular wall of the chamber around the entire periphery of the bar.

A transversely extending circular hole 60 is formed through the bar 55 immediately downstream of the orifice 45. The hole 60 communicates with the orifice 45 and, as pressurized liquid is discharged from the orifice, its strikes the downstream wall of the hole. The downstream wall thus defines an impingement surface which deflects the liquid transversely to break up the liquid and causes the liquid to flow through the chamber 56 along the sides of the bar 55.

At the same time, the liquid is further preliminarily broken up by a pressurized stream of air admitted into the chamber 56 through the circular air inlet port 21 (FIG. 2), which extends transversely to the chamber and the stream of liquid flowing through the chamber. As shown in FIGS. 1 and 2, the axis of the air inlet port 21 extends parallel to the axis of the hole 60 in the bar 55, but the port 21 is smaller in diameter than the hole 60 and its axis is offset in a downstream direction from the axis of the hole. As a result, only about one-half of the area of the air inlet port 21 is in registry with the hole 60 while the downstream half of the air inlet port is located in opposing relation with a side surface area 66 (FIG. 3) of the bar 55. By virtue of this arrangement, the surface 66 defines an impingement surface which deflects and breaks up the air stream. Considerable turbulence for preatomizing the liquid stream is created by the air stream being broken up by the impingement surface 66, by the liquid stream being broken up by the wall of the hole 60, and as a result of the air stream being injected transversely into the longitudinally flowing liquid stream. The liquid flow in the downstream direction toward the nozzle tip 15, therefore, is in the form of finely divided preatomized particles.

The insert 40 is completed by two radially spaced webs 70 (FIG. 1) formed integrally with and extending axially from the bar 55 and having downstream ends joined to a cylindrical sleeve 71. Formed on the downstream end of the sleeve is an outwardly radially extending flange 72 which is adapted to be clamped by a cap 75 between a sealing gasket 76 and an internal shoulder at the downstream end portion of the nozzle body 11. The cap 75 in this instance is adapted for threaded engagement onto the hub 12. An axially extending key 73 (FIG. 1) at the upstream side of the flange 72 fits into a keyway in the nozzle body 11 so as to orient the insert 40 angularly in the body in such a manner that the axis of the hole 60 extends parallel to the axis of the air inlet port 21. With the insert 40 is in place in the nozzle body 11, the flow rate of the liquid stream is reduced by the orifice 45 and, in addition, the stream is preliminarily atomized by the coaction of the wall of the hole 60, the impingement surface 66 of the bar 55 and the mutually transverse flow relation between the liquid stream and the air stream.

The preliminarily atomized liquid flow stream is then directed through a discharge orifice 78 formed in the nozzle tip 15 which in this case is disposed in coaxial relation to the nozzle body. For mounting the nozzle tip in axially extending relation to the hub 12 of the body 11, the nozzle tip 15 is formed with a radially extending peripheral flange 79 that is clamped to the end of the hub 12 by the cap 75. The annular gasket 76 is interposed between the tip 15, the cap 75 and the end of the hub 12 in order to seal the perimeter of the tip 15.

In accordance with the invention, the nozzle tip has an integrally formed deflector flange disposed in downstream relation to the discharge orifice of the nozzle tip in transversely oriented fashion to the line of travel of the liquid directed through the discharge orifice and the deflector flange is formed with a recessed area in axial alignment with the discharge orifice into which preatomized liquid is forcefully directed for breaking the preatomized droplets into extremely fine liquid particles which are then deflected into a flat, wide spray pattern in a manner which maximizes their exposure to the ambient air. In the illustrated embodiment, the nozzle tip 15 has an integrally formed deflector flange 80 defined by a slot 91 extending into one side of the nozzle tip 15. The deflector flange 80 has a significantly greater width than the discharge orifice 78 and in this case extends transversely in a slightly forwardly oriented direction so as to define an angle $\phi$ of about 75° with the longitudinal axis of the nozzle body 11. The deflector flange 80 in this instance is formed with a cup shaped recess 85 which has a diameter "d" substantially the same as the diameter of the discharge orifice 78 and which extends in a downstream direction into the deflector flange a discrete distance "l", corresponding substantially to the diameter "d" of the cup shaped recess (FIG. 1). The cup shaped recess 85 is in axial alignment with the discharge orifice 78 for directly receiving preatomized spray forcefully discharging from the discharge orifice 78.

It has been found that utilization of the deflector flange 80 with the cup shaped recess 85 is effective for breaking preatomized spray into extremely fine liquid particles, even when using relatively low liquid and air pressures. While not fully understood, it is believed that the cup shaped recess produces pressure waves or acoustic energy which assists in the liquid breakdown. The breakdown is enhanced by the reflector flange, which further serves to direct the discharging particles into a wide flat 180° spray pattern, as depicted in FIG. 4, so as to maximize the exposure of the fine liquid particles to the ambient air.

The nozzle assembly 10 of the present invention has been found to have particular utility in humidification and evaporative cooling applications with modest energy requirements. Extremely fine particle generation and distribution has been achieved using city water pressure with inexpensive plastic tubing and with air pressures less than the applied water pressure. Typically, water line pressure may be in the range of 30 to 50 psi and air pressure in the range of 20 to 40 psi. In operation, the nozzle of the present invention has been found to produce a spray having liquid particles sizes of about 13 microns median volume diameter using 40 psi air pressure and 50 psi water pressure. Liquid particle sizes of about 19 microns median volume diameter have been produced using 40 psi liquid pressure and 30 psi air pressure. In both instances, a relatively wide band spray pattern was produced which facilitates humidification and/or evaporation of the particles into the ambient air.

While the nozzle assembly of the present invention has particular utility when operated in an air assisted mode as described above, the deflector flange with the cup shaped recess facilitates liquid particle breakdown and direction even when the nozzle is operated in a purely hydraulic mode. In the illustrated embodiment, the nozzle assembly 10 may be converted for use in a purely hydraulic mode by removing the insert member 40, as described in greater detail in the aforementioned application Ser. No. 940,290. The insert member 40 may be removed from the body 11 by unscrewing the cap 75 and taking the cap 75, the nozzle tip 15, and the sealing gasket 76 off the body. Thereafter, the insert member 40 with the attached pin 48 and strainer 46 may be pulled axially out of the downstream into the body 11. Upon reassembly of the strainer 46 and cap 75, and with the air shutoff valve 22 closed, the nozzle may be operated in the hydraulic mode. During such operating mode, pressurized liquid is directed through the nozzle at a relatively high flow rate, discharges through the discharge orifice 78 of the nozzle tip 15 into the cup shaped recess 85, is broken down upon impact, and is then directed by the deflector flange 80 into a substantially 180° fan spray pattern. The hydraulic mode of operation may be preferred for use under conditions where it is desired to distribute larger quantities of liquid and with relatively larger particle sizes, as compared to when operating in the air assisted mode.

Figure 7B:
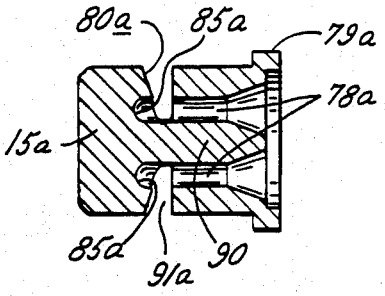
FIG 7B is a vertical section of the nozzle tip, taken in the plane of line 7B 13 7B in FIG. 7A.

Referring now to FIGS. 6 and 7A–7C, there is shown an alternative form of spray nozzle assembly embodying the present invention, wherein items similar to those described above have been given similar reference numerals with the distinguishing suffix "a" added. The nozzle tip **15*a* of the nozzle assembly 10*a* in this instance has a pair of deflector flanges 80*a* extending from opposed sides of the spray tip 15*a*, defined by slots 91*a* that extend into respective opposite sides of the spray tip 15. The deflector flanges 80*a* thereby extend from a common outwardly extending central section 90 of the spray tip 15*a* (FIG. 7B). The spray tip 15*a* is formed with pair of discharge orifices 78*a* located on opposed sides of the longitudinal axis of the nozzle, each for discharging preatomized liquid against a respective one of the deflectors flanges 80*a*. The deflector flanges 80*a* each are formed with a cup shaped recess 85*a* in axial alignment with the respective discharge orifices 78*a*** for receiving a preatomized discharge, which is then broken down further into extremely fine liquid particles and directed in a 180° flat spray pattern from respective sides of the spray tip, in a manner substantially similar to that described above.

Figure 8A:
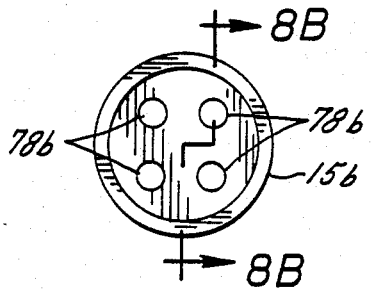
FIG. 8A is a rear end view of an alternative form of nozzle tip that can be utilized in the nozzle assembly of the present invention taken in the plane of line 8A—8B in FIG. 8C.
Figure 8B:
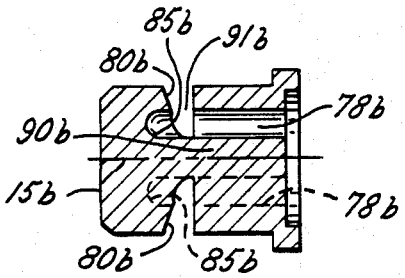
FIG. 8B is a vertical section of the nozzle tip shown in FIG. 8A, taken in the plane of line 8B—8B in FIG. 8A.
Figure 7C:
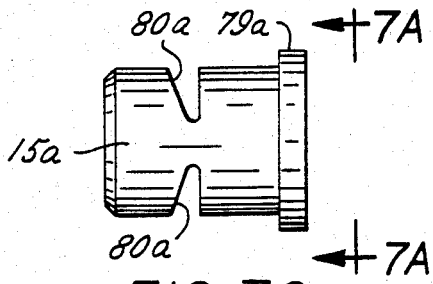
FIG. 7C is a side view of the nozzle tip shown in FIG. 6.
Figure 8C:
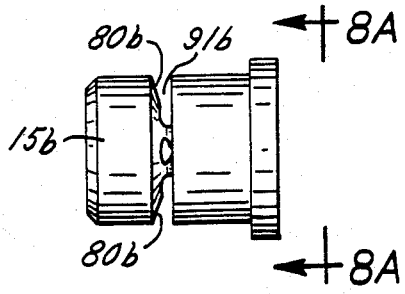
FIG. 8C is a side view of the nozzle tip shown in FIG. 8A.

Referring now to FIGS. 8A–8C, there is shown another alternative nozzle tip **15*b* which may be used in the spray nozzle assembly of the present invention, wherein items similar to those described above have been given similar reference numerals with the distinguishing suffix "b" added. The nozzle tip 15*b* in this instance is formed with an annular deflector 80*b* formed by an annular groove 91*b* which completely surrounds the outer periphery of the spray tip 15*b*, causing the annular deflector 80*b* to be supported in axial spaced relation to the discharge orifices 78*b* b by a central axial post 90*b* (FIG. 8B). The nozzle tip 15*b* includes four discharge orifices 78*b* circumferentially spaced at 90° intervals to each other about the central post 90*b*, each being adapted for discharging a stream into a respective cup shaped recess 85*b* in the annular deflector flange 80*b*. The simultaneous direction of a multiplicity of preatomized flow streams through the discharge orifices 78*b*** in such manner produces a 360° fan shaped spray pattern of fine particles about the entire periphery of the nozzle tip.

From the foregoing, it can be seen that the spray nozzle assembly of the present invention is adapted to efficiently produce a spray pattern with fine liquid particles which are disbursed in a flat fan spray pattern for maximizing exposure of the particles to ambient air so as to enhance humidification and/or evaporation. The spray nozzle assembly is operable to produce such a fine spray pattern, while using relatively low liquid and air pressures. As a result, the nozzle assembly lends itself to relatively economical use, permitting the utilization of inexpensive plastic air and liquid conduits and inexpensive low pressure sealing designs.

I claim as my invention:

1. An air assisted nozzle assembly comprising:

a hollow nozzle body means defining an air inlet orifice through which a pressurized air stream is directed into said body, means defining a liquid inlet orifice through which a pressurized liquid stream is directed into said body, means within said body for intermixing said liquid and air streams for preatomizing the liquid, means defining a discharge orifice through which said preatomized liquid is directed, at least one deflector flange downstream of said discharge orifice and transverse to the direction of travel of said preatomized liquid through said discharge orifice, and said deflector flange being formed with an annular, cup shaped, turbulence creating recess in coaxial alignment with said discharge orifice and extending a discrete distance into said deflector flange into which said preatomized liquid is directed from said discharge for causing turbulance, further breakdown, and atomization of said liquid which is thereupon directed by said reflector flange transversely in a substantially flat spray pattern.

2. The spray nozzle assembly of claim 1 in which said cup shaped recessed area has diameter that is substantially the same as the diameter of the discharge orifice.

3. The spray nozzle assembly of claim 1 in which said discharge orifice defining means is a spray tip that is removably mounted on said body.

4. The spray nozzle assembly of claim 3 including a pair of diametrically opposed deflector flanges, said spray tip being formed with a pair of discharge orifices, said discharge orifices each being adapted for directing preatomized liquid against a respective one of said deflector flanges, and said deflector flanges each being formed with a recessed area in axial alignment with the respective discharge orifice.

5. The spray nozzle assembly of claim in which said deflector flange defines a transverse deflective surface oriented in a slightly downstream direction.

6. The spray nozzle assembly of claim 5 in which said deflector surface forms an angle of about 75° with the longitudinal axis of said body.

7. The spray nozzle assembly of claim 1 in which said nozzle body has an elongated configuration which defines a mixing chamber through which said preatomized liquid is directed toward said discharge orifice, and said discharge orifice is disposed on the longitudinal axis of said mixing chamber.

8. The spray nozzle assembly of claim 1 in which said intermixing and preatomizing means includes means defining an impingement surface in said body, said impingement surface being disposed such that a liquid stream directed through said body strikes the impingement surface at substantially a right angle thereto.

9. A spray nozzle assembly comprising:

a hollow nozzle body, means defining a liquid inlet orifice through which a pressurized liquid flow stream is directed into and through said body, means defining a discharge orifice through which said liquid flow stream is discharged, at least one deflector flange downstream of said discharge orifice and transverse to the direction of travel of the liquid flow stream discharging from said discharge orifice, and said deflector flange being formed with an annular, cup shaped, turbulence creating recess in coaxial alignment with said discharge orifice and extending a discrete distance into said deflector flange into which said liquid flow stream is directed from said discharge orifice for causing turbulance, breakdown, and atomization of said liquid flow stream which is thereupon directed by said deflector flange transversely in a substantially flat spray pattern.

10. The spray nozzle assembly of claim 9 in which said cup shaped recess has a diameter that is substantially the same as the diameter of the discharge orifice.

11. A nozzle tip comprising:

a nozzle tip body portion into which a liquid flow stream is directed, said nozzle tip body portion into which a liquid flow stream is directed, at least one deflector flange downstream of said discharge orifice and transverse to the direction of travel of said liquid flow stream discharging from said discharge orifice, and said deflector flange being formed with an annular, cup shaped turbulence creating recess in coaxial alignment with said discharge orifice and extending a discrete distance into said deflector flange into which said liquid flow stream discharges from said discharge orifice for causing turbulence, breakdown, and atomization of the liquid which is thereupon directed transversely by said deflector flange in a substantially flat spray pattern.

12. The spray tip assembly of claim 1 in which said cup shaped recess has a diameter that is substantially the same as the diameter of the discharge orifice.

13. The spray nozzle tip of claim 1 in which said deflector flange extends from one side of said body portion.

14. The spray nozzle tip of claim 11 including a pair of deflector flanges extending from opposite sides of said body portion, said body portion being formed with a pair of discharge orifices, said discharge orifices each being adapted for directing a liquid flow stream against a respective one of said deflector flanges, and said deflector flanges each being formed with a recess in axial alignment with the respective discharge orifice.

15. The spray nozzle tip of claim 11 in which said deflector flange defines a transverse deflector surface oriented in slightly downstream direction.

16. An air assisted nozzle assembly comprising:

a hollow nozzle body, means defining an air inlet orifice through which a pressurized air stream is directed into said body, means defining a liquid inlet orifice through which a pressurized liquid stream is directed into said body, means within said body for intermixing said liquid and a streams for preatomizing the liquid, means defining a discharge orifice through which said preatomized liquid is directed, and least one deflector flange located downstream of said discharge orifice and transverse to the direction of travel of said preatomized liquid through said discharge orifice, means defining a recess in said deflector flange in a alignment with said discharge orifice into which said preatomized liquid is directed from said discharge orifice for causing further breakdown and atomization of said liquid which is thereupon directed by said deflector flange transversely in a substantially flat spray pattern, and said recess being cup shaped with a diameter substantially the same as the diameter of said discharge orifice and extending into said deflector flange a discrete distance corresponding substantially to the diameter of said recess.

17. An air assisted nozzle assembly comprising:

a hollow nozzle body, means defining an air inlet orifice through which a pressurized air stream is directed into said body, means defining a liquid inlet orifice through which a pressurized liquid stream is directed into said body, means within said body for intermixing said liquid and air streams for preatomizing the liquid, a spray tip removably mounted on said body, said spray tip having a plurality of discharge orifices for simultaneously discharging preatomized liquid, said spray tip being formed with an annular deflector flange downstream of said discharge orifices and transverse to the direction of travel of said preatomized liquid directed through said discharge orifices, said annular deflector flange being formed with a of recessed areas each being in axial alignment with a respective one of said discharge orifices into which preatomized liquid from said plurality of said discharge orifices is directed for further breakdown and atomization of said liquid which is thereupon directed by said deflector flange in a transverse flat spray pattern.

18. A spray nozzle assembly comprising:

a hollow nozzle body, means defining a liquid inlet orifice through which a pressurized liquid flow stream is directed into and through said body, means defining a discharge orifice through which said liquid flow stream is discharged, means defining a deflector flange downstream of said discharge orifice and transverse to the direction of travel of the liquid flow stream discharging from said discharge orifice, means defining a recess in said deflector flange in axial alignment with said discharge orifice into which said liquid flow stream is directed from said discharge orifice for causing breakdown and atomization of said liquid flow stream which is thereupon directed by said deflector flange transversely in a substantially flat spray pattern, and said recess being cupped shaped with a diameter substantially the same as the diameter of said discharge orifice and extending into said deflector flange a discrete distance corresponding substantially to the diameter of said recess.

19. A nozzle tip comprising:

a nozzle tip body portion into which a liquid flow stream is directed, said nozzle tip body portion defining a discharge orifice through which said liquid flow stream is discharged, a deflector flange downstream of said discharge orifice a transverse to the direction of travel of said liquid flow stream discharging from said discharge orifice, said deflector flange being formed with a recess in alignment with said discharge orifice into which said liquid flow stream discharges from said discharge orifice for causing breakdown and atomization of the liquid which is thereupon directed transversely by said deflector flange in a substantially flat spray pattern, and said recess being cupped shaped with a diameter substantially the same as the diameter of said discharge orifice and extending into said deflector flange a discrete distance corresponding substantially to the diameter of said recess.

20. A nozzle tip comprising:

a nozzle tip body portion into which a liquid flow is directed, nozzle tip body portion defining a plurality of discharge orifices for simultaneously discharging a plurality of liquid flow streams, an annular configured deflector flange downstream of said discharge orifice and transverse to the direction of travel of said plurality liquid flow streams discharging from said discharge orifices, and said deflector flange being formed with a plurality of recesses each being in axial alignment with a respective one of said discharge orifices into which said liquid flow streams discharge from said discharge orifices for causing breakdown and atomization of the liquid which is thereupon directed transversely by said deflector flange in a substantially flat spray pattern.

* * * * *

UNITED STATES PATENT AND TRADEMARK OFFICE

CERTIFICATE OF CORRECTION

PATENT NO. : 4,828,182

DATED : May 9, 1989

INVENTOR(S) : James Haruch

It is certified that error appears in the above-identified patent and that said Letters Patent is hereby corrected as shown below:

In Claim 5 (at Col.7, line 36), after "claim" insert --1--.

In Claim 16 (at Col. 8, line 55), at the beginning of the line, insert "at".

In Claim 16 (at Col. 8, line 59), change "in a" to --in axial--.

Signed and Sealed this

Seventeenth Day of July, 1990

*Attest:*

HARRY F. MANBECK, JR.

*Attesting Officer*

*Commissioner of Patents and Trademarks*